US005311808A

United States Patent [19]

Ando

[11] Patent Number: 5,311,808

[45] Date of Patent: May 17, 1994

[54] CYLINDER APPARATUS

[75] Inventor: Etuo Ando, Tokyo, Japan

[73] Assignee: Ando Seisakujo Co., Ltd., Tokyo, Japan

[21] Appl. No.: 16,834

[22] Filed: Feb. 12, 1993

[51] Int. Cl.[5] ..... F15B 15/20; F15B 7/00

[52] U.S. Cl. ..... 91/392; 91/461; 60/533; 60/546

[58] Field of Search ..... 60/533, 546; 91/1, 184, 91/190, 392, 403, 461

[56] References Cited

U.S. PATENT DOCUMENTS

| | | | |
|---|---|---|---|
| 2,456,236 | 12/1948 | Acton | 91/403 |
| 3,216,444 | 11/1965 | Herner | 91/403 X |
| 3,537,356 | 11/1970 | Odell | 91/1 X |
| 3,691,902 | 9/1972 | Lebzelter | 91/1 |
| 3,832,852 | 9/1974 | Schmucker | 60/546 |
| 3,990,349 | 11/1976 | Valantin | 91/461 X |
| 3,999,464 | 12/1976 | Grieger et al. | 91/461 X |
| 4,463,563 | 8/1984 | Krehbiel | 60/546 X |
| 4,919,039 | 4/1990 | Nutter | 91/461 X |

*Primary Examiner*—Edward K. Look
*Assistant Examiner*—John Ryznic
*Attorney, Agent, or Firm*—Walter C. Farley

[57] ABSTRACT

A cylinder apparatus capable of effectively restraining a loss of energy with a simple structure at a low cost. When a piston 16 of a main cylinder 11 cuts off a communication between a subchamber 20 and a supply/exhaust passage 32, a pressure of the subchamber 20 is pushed by the piston 16 and thereby increased. However, an exhaust fluid from the subchamber 20 having the increased pressure is fed to a subcylinder 62. A piston 48 is moved while controlling a velocity by a flow rate control valve 70 in synchronization with the piston 16. This arrangement eliminates a necessity for a special position detector, etc.. The structure is therefore simplified, and the cost decreases. Simultaneously, the energy can be effectively utilized because of employing the exhaust fluid.

6 Claims, 5 Drawing Sheets

CYLINDER APPARATUS

BACKGROUND OF THE INVENTION

1. Field of the Invention

The present invention relates to a cylinder apparatus in which a subcylinder is operated by a fluid exhausted from a main cylinder.

2. Related Background Art

Generally, in the industrial field, when a piston of a certain cylinder moves to a predetermined position, a piston of another cylinder starts moving in synchronization with the former cylinder. In this case, according to the prior arts, a position detector detects a position of the piston of the cylinder. At the same time, when the piston of the cylinder moves to the predetermined position, a changeover valve is changed over in accordance with a signal transmitted from the position detector. The piston of another cylinder is moved by supplying the fluid from another pump to another cylinder.

This type of conventional cylinder apparatus, however, involves the use of a special position detector, a changeover valve and intricate piping and wiring. This presents such problems that the structure becomes complicated, and the cost increases. Besides, there arises a problem, wherein the fluid supplied to another cylinder is normally returned to a tank (when not supplied to another cylinder), and a large loss of energy is to be caused.

SUMMARY OF THE INVENTION

It is a primary object of the present invention to provide a cylinder apparatus capable of effectively restraining a loss of energy with a simplified structure at a low cost.

To accomplish this object, according to one aspect of the invention, there is provided a cylinder apparatus comprising: a main cylinder incorporating a cylinder chamber partitioned into two subchambers by a piston; a pair of supply/exhaust passages, connected to the two subchambers of the main cylinder, for supplying and exhausting a fluid to and from the two subchambers; a cut-off member, provided on the piston of the main cylinder, for cutting off a communication between one subchamber from which the fluid is pushed and one supply/exhaust passage on a low pressure side when the piston moves toward one stroke end and reaches the vicinity of one stroke end; a subcylinder incorporating a cylinder chamber partitioned into two subchambers by a piston; a connection passage for always connecting any one of the subchambers of the subcylinder to one subchamber of the main cylinder and causing a movement of the piston of the subcylinder by leading the fluid of one subchamber of the main cylinder having an increased pressure due to a cut-off by the cut-off member into the subchamber of the subcylinder; an escape passage for connecting the middle of the connection passage to one supply/exhaust passage on the low pressure side and escaping the fluid of the connection passage to one supply/exhaust passage on the low pressure side; and a flow rate control valve, provided in the middle of said escape passage, for controlling a flow rate of the fluid to be escaped.

Now, it is assumed that a high-pressure fluid is supplied from the high-pressure-side supply/exhaust passage, herein from the other supply/exhaust passage, to the subchamber of the main cylinder, herein to the other subchamber; and the piston of the main cylinder moves toward one stroke end. At this time, the low-pressure-side supply/exhaust passage and the connection passage are connected to the remaining subchamber of the main cylinder, herein to one subchamber. It is therefore considered that the fluid in one subchamber flows out via both the supply/exhaust passage and the connection passage. The subcylinder and the flow rate control valve are, however, connected to the connection passage. A resistance is therefore large, with the result that the fluid in one subchamber is exhausted via only one supply/exhaust passage but does not flow via the connection passage. As a result, the piston of the subcylinder does not move at this point of time. Then, when the piston of the main cylinder reaches a predetermined position in the vicinity of one stroke end, the cut-off member cuts off a communication between one subchamber and one supply/exhaust passage. Even after this cut-off process, the piston moves toward one stroke end. A pressure of the fluid in one subchamber therefore rises. Simultaneously, the fluid is pushed out by the piston. A predetermined quantity of the fluid thus pushed out flows into any one of the subchambers of the subcylinder via the connection passage. At the same time, a predetermined quantity of remaining fluid escapes into one supply/exhaust passage via the escape passage and the flow rate control valve. In consequence, the piston of the subcylinder starts moving in synchronization with the piston of the main cylinder. At this moment, a quantity of the fluid flowing into the subcylinder is regulated by controlling a flow rate of the fluid flowing through the flow rate control valve. A moving velocity of the piston of the subcylinder can be thereby determined. As described above, the piston of the subcylinder is moved by cutting off the communication between one subchamber and one supply/exhaust passage with the piston of the main cylinder and flowing the fluid into the connection passage from one subchamber. Hence, there is no necessity for the special position detector, the changeover valve and intricate piping and wiring as in the prior arts. The structure is thus simplified, and simultaneously the whole apparatus decreases in terms of cost. Besides, the fluid supplied to the subcylinder is an exhaust fluid from the main cylinder. The energy can be therefore effectively utilized.

The two subcylinders are controllable by the main cylinder.

The subcylinder can be remote controlled by the main cylinder.

The insertion member provided as a buffer member for the main cylinder also incorporates a cut-off function, and the structure is therefore simplified.

A moving position of the piston of the main cylinder can be detected in the subcylinder.

A corresponding relationship between the moving position of the piston of the main cylinder and that of the piston of the subcylinder becomes obvious, and the control is simplified.

BRIEF DESCRIPTION OF THE DRAWINGS

Other objects and advantages of the present invention will become apparent during the following discussion in conjunction with the accompanying drawings, in which.

DETAILED DESCRIPTION OF THE PREFERRED EMBODIMENT

One embodiment of the present invention will hereinafter be described with reference to the drawings.

Figure 1:
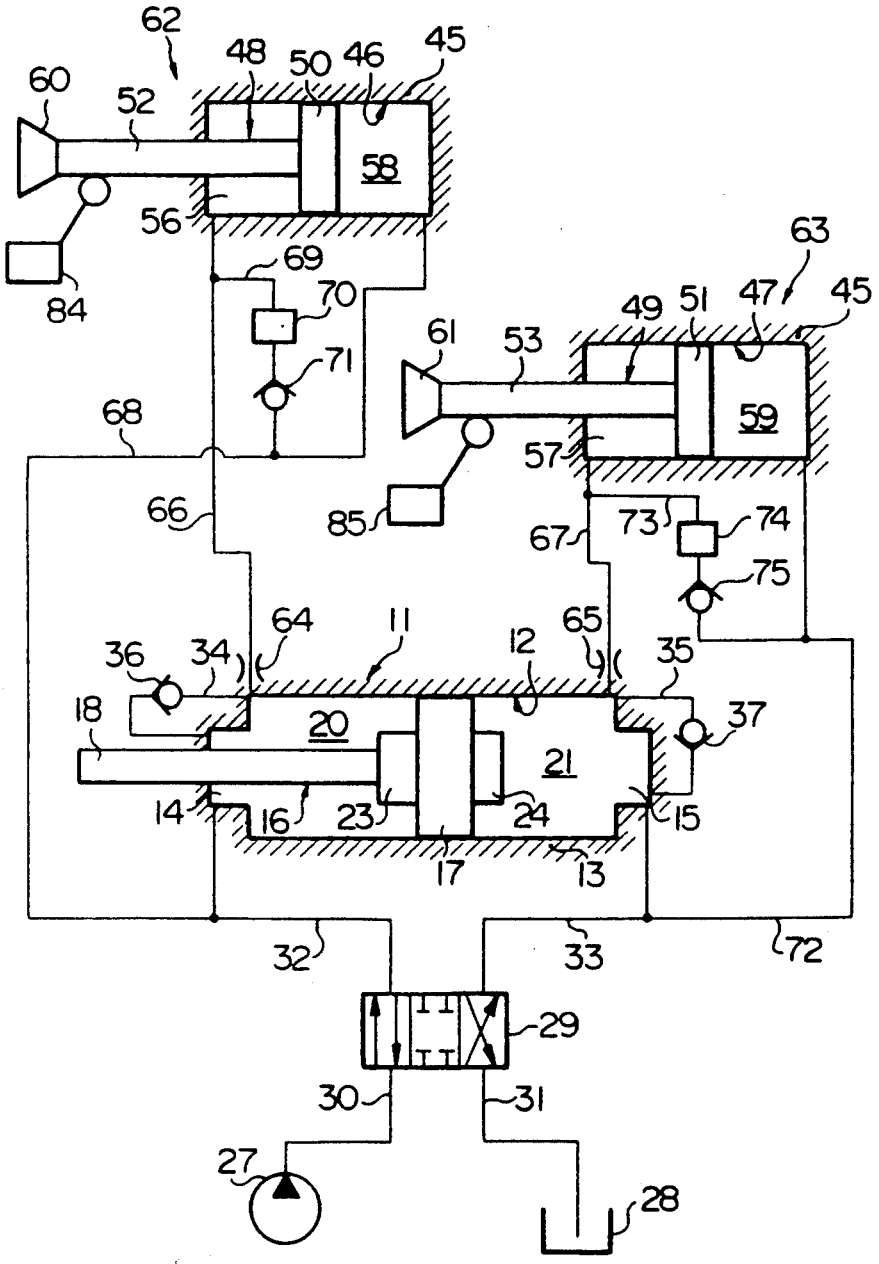
FIG. 1 is a schematic sectional view of the whole with some members indicated by symbols, showing one embodiment of this invention.
Figure 2:
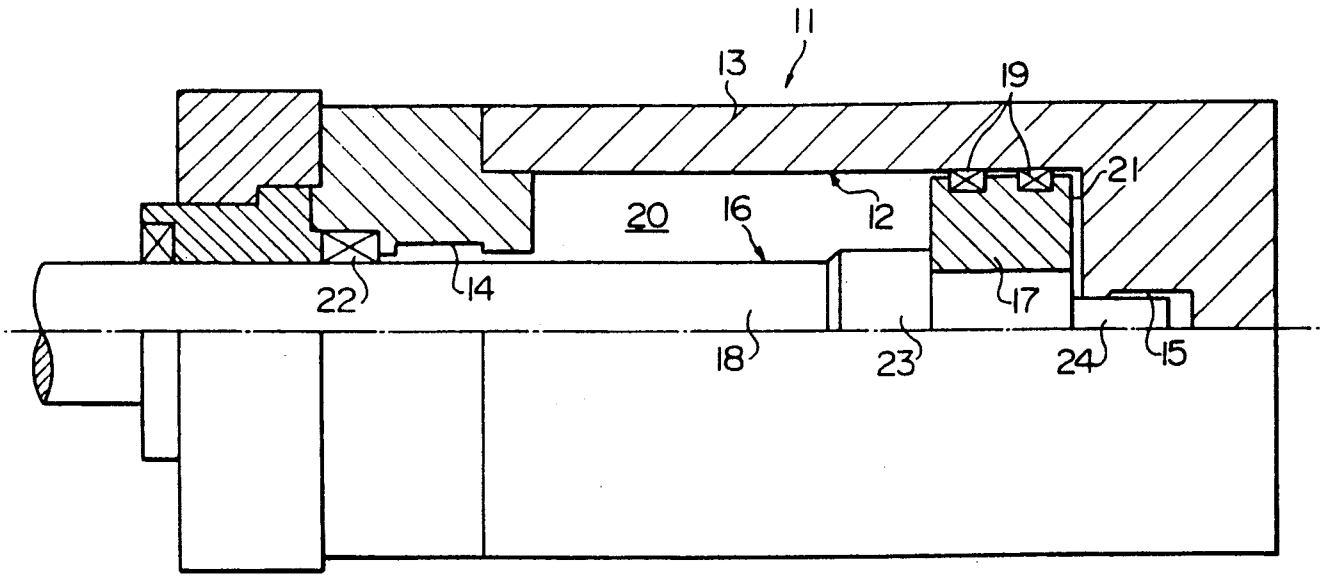
FIG. 2 is a front sectional view illustrating a main cylinder.

Referring to FIGS. 1 and 2, a main cylinder 11 is employed for mold clamping of a die-cast machine. This main cylinder 11 incorporates a cylinder case 13 in which a cylinder chamber 12 extending in the axial direction is internally formed. A hole 14 having a diameter smaller than that of the cylinder chamber 12 communicates with one end of this cylinder chamber in the axial direction. Further, a similar insertion hole 15 communicates with the other end of the cylinder chamber 12 in the axial direction. A piston 16 is slidably into the cylinder chamber 12. This piston 16 includes a large-diameter piston member 17 and a rod member 18 the other end of which is fixed to this piston member 17. A major diameter of the piston member 17 is slightly smaller than a minor diameter of the cylinder chamber 12. A U-packing 19 for sealing a portion between the cylinder chamber 12 and the piston member 17 is fitted to the outer periphery of the piston member 17. Then, this piston member 17 partitions the cylinder chamber 12 into a subchamber 20 located on one side and a subchamber 21 located on the other side. Further, the rod member 18 penetrates one end portion of the cylinder case 13 at its central part. A Unpacking 22 fitted to the cylinder case 13 seals the portion between the rod member 18 and the cylinder case 13. An insertion member 23 serving as a cut-off member contiguous to the piston member 17 is formed on one side of the rod member 18 with respect to the piston member 17. A major diameter of this insertion member is substantially the same as the diameter of the insertion hole 14. Besides, an insertion member 24 serving as another cut-off member contiguous to the piston member 17 is formed on the other side of the rod member 18 with respect to the piston member 17. A major diameter of this insertion member 24 is substantially the same as a diameter of the insertion hole 15.

The numeral 27 designates a pump for discharging a pressure fluid. The numeral 28 represents a tank. The pump 27, the tank 28 and a changeover valve are connected to each other via a discharge passage 30 and an exhaust passage 31. This changeover valve 29 is connected via a pair of supply/exhaust passages 32, 33 to the insertion holes 14, 15. Consequently, the subchambers 20, 21 of the main cylinder 11 are connected via the insertion holes 14, 15 to the supply/exhaust passages 32, 33. The changeover valve 29 is changed over. Any one of the supply/exhaust passages 32, 33 is thereby set to a high pressure side, whereas the other is set to a low pressure side. The fluid is supplied to the subchambers 20, 21, or reversely the fluid is exhausted from the subchambers 20, 21. Further, one and the other ends of the cylinder chamber 12 are connected via communication passages 34, 35 to the insertion holes 14, 15. Check valves 36, 37 are provided in the middles of these communication passages 34, 35, respectively. The check valves permit only a flow of the fluid from the insertion holes 14, 15 to the cylinder chamber 12. Then, when the piston 16 moves toward one stroke end and comes to the vicinity of this one stroke end, the insertion member 23 starts entering the insertion hole 14. The communication between the supply/exhaust passage 32 and the subchamber 20 is therefore cut off. On the other hand, when the piston 16 moves toward the other stroke end and comes to the vicinity of the other stroke end, the insertion member 24 starts entering the insertion hole 15. The communication between the supply/exhaust passage 33 and the subchamber 21 is therefore cut off.

Referring to FIGS. 1, 3, 4 and 5, a cylinder case 45 is mounted in a position far away from the main cylinder 11, e.g., on an operation panel. This cylinder case 45 encases a pair of cylinder chambers 46, 47 parallel to each other. Pistons 48, 49 are slidably inserted into the cylinder chambers 46, 47, respectively. These pistons 440, 49 include large-diameter piston members 50, 51 and rod members 52, 53 the other ends of which are fixed respectively to these piston members 50, 51. Major-diameters of the piston members 50, 51 are slightly smaller than minor-diameters of the cylinder chambers. O-rings 54, 55 for sealing portions between the cylinder chambers 46, 47 and the piston members 50, 51 are attached to the outer peripheries of the piston members 50, 51. Then, the cylinder chambers 46, 47 are each partitioned into two subchambers, i.e., subchambers 56, 57 located on one side and subchambers 58, 59 located on the other side by the piston members 50, 51. Besides, the rod members 52, 53 penetrate one end portion of the cylinder case at their central parts. Engagement members 60, 61 each assuming a fan-shaped circular conical trapezoid expanding toward one end are fixed to one ends of the rod members. The cylinder case 45 and the piston 48 constitute a subcylinder 62 on the whole which internally has a cylinder chamber 46 partitioned into two subchambers 56, 58 by the piston 48. Further, the cylinder case 45 (used in common to the subcylinder 62) and the piston 49 constitute another subcylinder 63 on the whole which internally has a cylinder chamber 47 partitioned into two subchambers 57, 58 by the piston 49. Then, in accordance with this embodiment, a moving velocity (distance) of the main cylinder 11 is equalized to each moving velocity (distance) of the subcylinders 62, 63 (one-to-one correspondence). Hence, an axial length of each of the insertion members 24, 24 is set identical with a stroke length of each of the subcylinders 62, 63.

Any one of subchambers of the subcylinder 62, herein the subchamber 56 on the rod side, is always connected to one subchamber of the main cylinder 11, herein to the subchamber 20 on the rod side, through a connection passage 66 consisting of a long pipe. Further, a throttle 64 is formed at one end portion of this connection passage 66 in the vicinity of the main cylinder 11. With this arrangement, the communication between the subchamber 20 and the supply/exhaust passage 32 is cut off by the insertion member 23. Besides, the fluid flowing from an interior of the subchamber 20 into the connection passage 66 is regulated by the throttle 64. Although a pressure within the subchamber 20 increases, the fluid in the subchamber 20 having the increased pressure is led via the connection passage 66 to the subchamber 56 of the subcylinder 62. The piston 48 of the subcylinder 62 is moved toward the head side. Further, any one of the subchambers of the subcylinder 63, herein the subchamber 57 on the rod side, is always connected to the other subchamber of the main cylinder 11, herein to the subchamber 21 on the head side, through another connection passage 67 consisting of a long pipe. Besides, a throttle 65 is formed at one end portion of this connection passage 67 in the vicinity of the main cylinder 11. With this arrangement, the communication between the subchamber 21 and the supply/exhaust passage 33 is cut off by the insertion member 24. Besides, the fluid flowing from an interior of the subchamber 21 into the connection passage 67 is regulated by the throttle 65. Although the pressure within the subchamber 21 increases, the fluid in the subchamber 21 having the increased pressure is led via the connection passage 67 to the subchamber 57 of the subcylinder 63. The piston 49 of the subcylinder 63 is moved toward the head side. The remaining subchamber 58 of the subcylinder 62 is connected via a long passage 68 to the middle of one supply/exhaust passage 32. Further, the connection passage 66 is connected via an escape passage 69 to the passage 58. This escape passage 69 is thereby connected via the passage 68 to the supply/exhaust passage 32. With this arrangement, some fluid in the connection passage 66 escapes into one supply/exhaust passage via this escape passage 69. Then, a check valve 71 is provided in the middle of this escape passage 69. The check valve 71 permits only a flow of the fluid running toward the passage 68 from a flow rate control valve 70 for adjusting a flow rate of the fluid to be escaped as well as from the connection passage 66. In addition, the remaining subchamber 59 of the subcylinder 63 is connected via a long passage 72 to the middle of the other supply/exhaust passage 33. Further, the connection passage 67 is connected via another escape passage 73 to the passage 72. This escape passage 73 is thereby connected via the passage 72 to the supply/exhaust passage 33. With this arrangement, some fluid in the connection passage 67 escapes into the other supply/exhaust passage 33 through this escape passage 73. Then, a check valve 75 is provided in the middle of this escape passage 73. The check valve 75 permits only a flow of the fluid running toward the passage 72 from another flow rate control valve 74 for adjusting a flow rate of the fluid to be escaped as well as from the connection passage 67. Then, with the above-mentioned arrangement, the two subcylinders 62, 63 are controllable by the single main cylinder 11.

Figure 3:
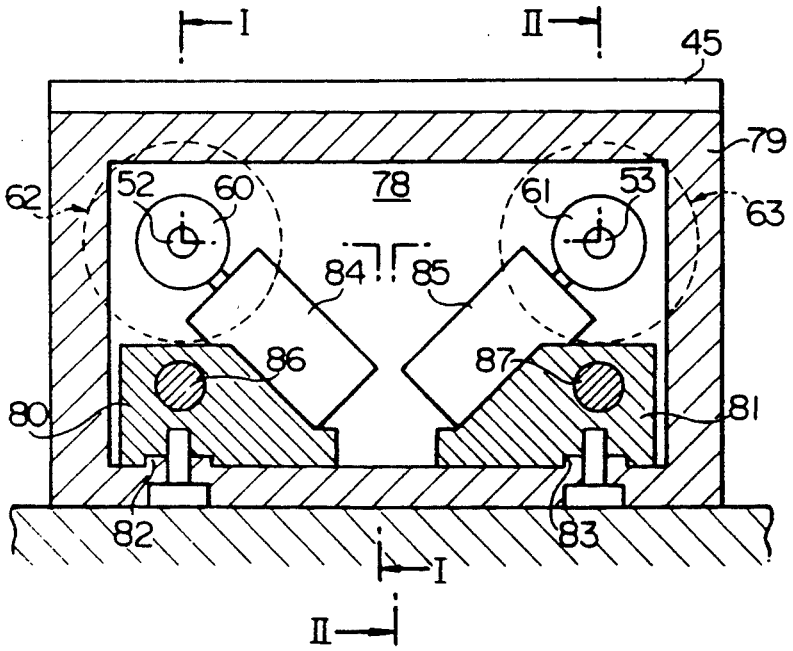
FIG. 3 is a side sectional view illustrating the vicinity of a microswitch.
Figure 4:
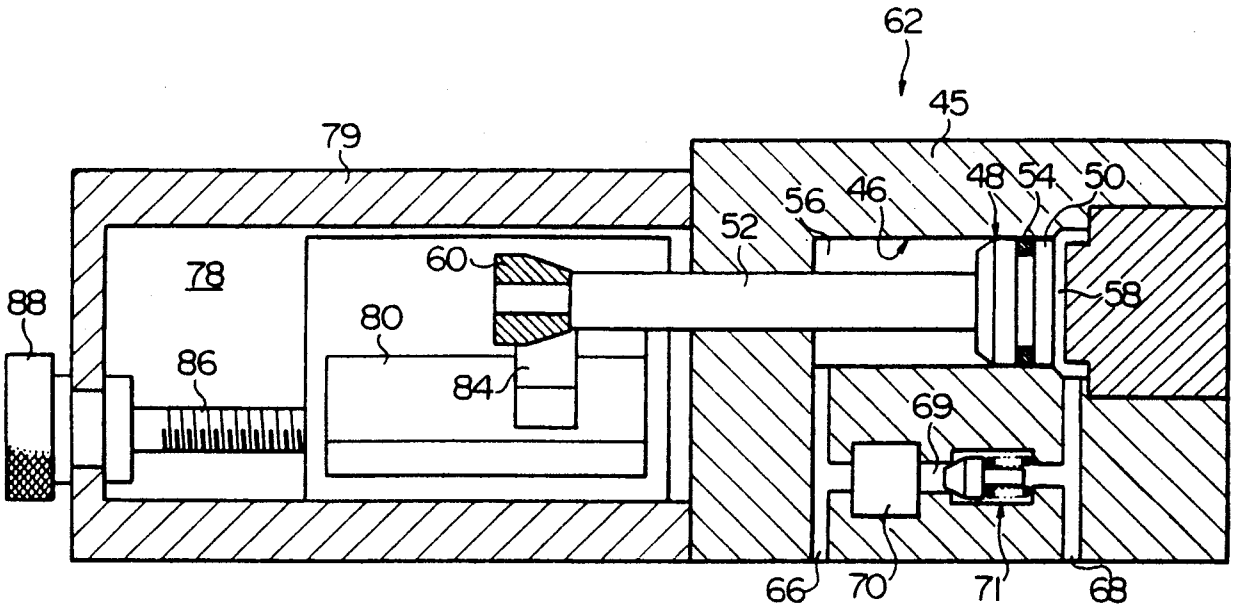
FIG. 4 is a sectional view taken substantially along the arrowed line I—I in FIG. 3.
Figure 5:
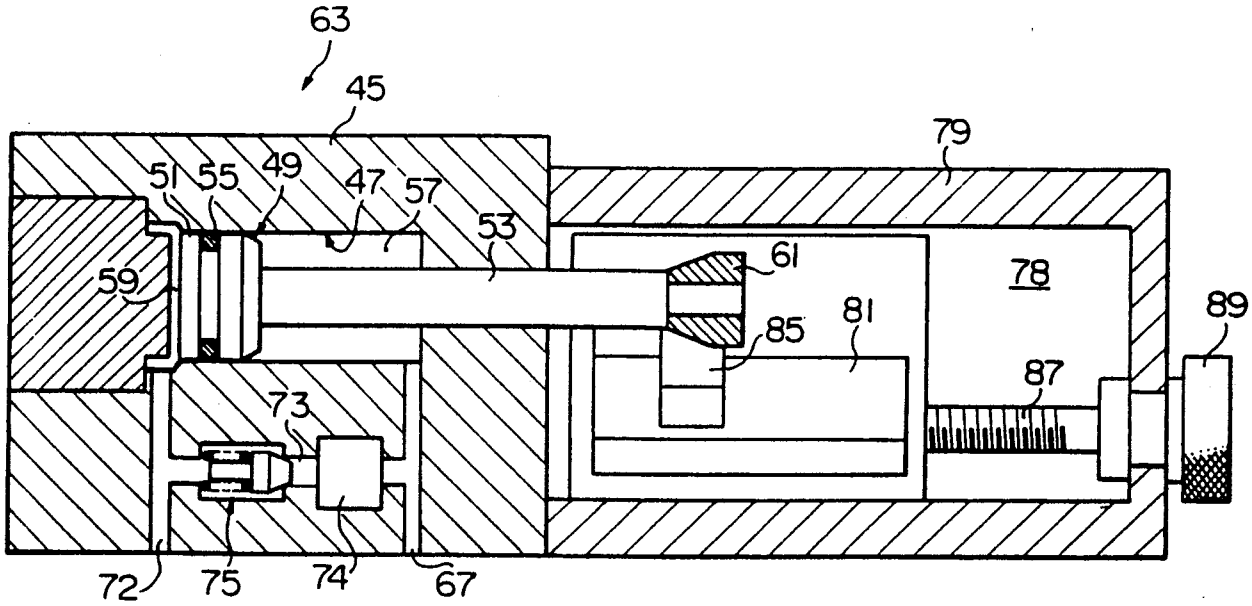
FIG. 5 is a sectional view taken substantially along the arrowed line II—II in FIG. 3.

Turning to FIGS. 3, 4, and 5, a case 79 formed inside with a cavity 78 is fixed in the vicinity of the subcylinders 62, 63, more particularly, onto one end surface of the cylinder case 45. A pair of sliders 80, 81 are slidably supported on the lower surface of a cavity 78 of this case 79. These sliders 80, 81 are movable along guide rails 82, 83 formed on the lower surface of the cavity 78 and extending in parallel to the rod members 52, 53 of the subcylinders 62, 63. The sliders 80, 81 are respectively fitted with microswitches 84, 85. These microswitches 84, 85 are turned ON when engaging with the engagement members 60, 61 but turned OFF when disengaged from the engagement members 60, 61. Then, when these microswitches 84, 85 are turned ON, the changeover valve 29 is changed over to a neutral position. The action of the main cylinder 11 stops. Screw shafts 86, 87 are screwed in the sliders 80, 81. These screw shafts 86, 87 extend in parallel to the guide rails 82, 83. Then, one ends of these screw shafts 86, 87 protrude from the case 79. Knobs 88, 89 are fixed to the one ends of the screw shaft 86, 87.

Next, the operation of one embodiment of this invention will be explained.

Now, it is assumed that a high-pressure fluid discharged from the pump 27 is supplied through the changeover valve 29 to the other supply/exhaust passage 33. On the other hand, a low pressure return fluid from one supply/exhaust passage 32 is discharged to the tank 28. As a result, the other supply/exhaust passage 33 is defined as a high-pressure-side supply/exhaust passage at the present, while one supply/exhaust passage 32 is defined as a low-pressure-side supply/exhaust passage. Then, the high-pressure fluid supplied to the other supply/exhaust passage 33 is supplied to the other subchamber 21 of the main cylinder 11. The piston 16 of the main cylinder 11 is thereby thrust by the high-pressure fluid and moves toward one stroke end. At this time, it is considered that the fluid in the subchamber 20 of the main cylinder 11 is pushed by the piston 16 and flows out via both the supply/exhaust passage 32 on the low pressure side and the connection passage 66. However, the subcylinder 62 and the flow rate control valve 70 are connected to the connection passage 66, and the resistance is large. Therefore, the fluid is discharged to the tank 28 through only the low-pressure-side supply/exhaust passage 32 having the least resistance but does not flow via the connection passage 66. In consequence, the piston 48 of the subcylinder 62 does not move at this moment. Besides, the high-pressure fluid is at this time supplied also to the subchamber 59 of the subcylinder 63. Hence, the piston 49 of the subcylinder 63 moves up to the stroke end on the rod side.

Then, when the piston 16 of the main cylinder 11 reaches a predetermined position in the vicinity of one stroke end, the insertion member 23 serving as the cut-off member starts entering the insertion hole 14. At this moment, the major diameter of the insertion member 23 is substantially the same as the minor diameter of the insertion hole 14. Therefore, the communication between subchamber 20 and the supply/exhaust passage 32 is cut off by the insertion member 23. Then, the piston 16 is thrust by the high-pressure fluid and moves toward one stroke end even after this cut-off process. The fluid in the subchamber 20 is therefore pushed into the connection passage 66 by the piston 16. A flow of the fluid pushed into the connection passage 66 is herein regulated by the throttle 64. A moving velocity of the piston 16 is therefore reduced to effect a buffer action. Simultaneously, the internal pressure of the subchamber 20 rises. The insertion member 23 thus provided to exhibit a buffer function of the main cylinder 11 also incorporates a cut-off function, with the result that a structure of the whole apparatus is simplified. Then, the fluid having the increased pressure, as described above, passes through the throttle 64 and the connection passage 66. A predetermined quantity of fluid thereafter flows into the subchamber 56 of the subcylinder 62. At the same time, a predetermined quantity of remaining fluid escapes to the supply/exhaust passage 32 via the escape passage 69 and the flow rate control valve 70. As a result, the piston 48 of the subcylinder 62 synchronizes with the piston 16 of the main cylinder 11 and thus starts moving toward the rod side. At this time, a flow rate of the fluid flowing through the escape passage 69 is controlled by regulating an opening of the flow rate control valve 70. The flow rate of the fluid running into the subchamber 56 of the subcylinder 62 can be controlled. It is therefore possible to determine a moving velocity of the piston 48 of the subcylinder 62. In accordance with this embodiment, the moving velocity of the piston 16 of the main cylinder 11 is equalized to the moving velocity of the piston 48 by regulating the flow rate control valve 70. Herein, however, the axial length of the insertion member 23 is, as described above, set identical with the stroke length of the piston 48 of the subcylinder 62. Hence, when the piston 16 of the main cylinder 11 reaches one stroke end, the piston 48 of the subcylinder 62 comes to the stroke end on the head side. Made apparent consequently is the corresponding relationship (one-to-one relationship) between the moving position of the piston 16 of the main cylinder 11 and that of the piston 48 of the subcylinder 62. The control is thus simplified.

Then, when the piston 48 of the subcylinder 62 reaches the stroke end on the head side, the engagement member 60 engages with the microswitch 84. The microswitch 84 is thus turned ON. The microswitch 84 thereby detects a position of the piston 16 of the main cylinder 11, i.e., detects the fact that the piston 16 reaches one stroke end. The detection thereof is displayed on an unillustrated display unit. Simultaneously, a signal is transmitted to the changeover valve 29, whereby the changeover valve 29 is changed over to the neutral position to stop the operation of the main cylinder 11. Herein, the microswitch 84 for indirectly detecting the position of the piston 16 of the main cylinder 11 is disconnected by the subcylinder 62. The subcylinder 62 is remote manipulated by the exhaust fluid of the main cylinder 11. In the case of repairing the microswitch 84 that has been broken down, there is no necessity for effecting the work in the vicinity of the main cylinder 11 (if the main cylinder 11 operates due to an unexpected situation, an extremely dangerous state may happen in the vicinity of the main cylinder 11). As a result, the safety is improved. Further, the insertion member 23 of the main cylinder 11 cuts off the communication between the subchamber 20 and the supply/exhaust passage 32. The fluid flows from the main cylinder 11 into the connection passage 66. The piston 48 of the subcylinder 62 is thereby moved. Hence, there is no necessity for a special position detector, a changeover valve, intricate piping and wiring as in the prior arts. The structure is simplified, and at the same time the whole apparatus decreases in terms of cost. In addition, the fluid supplied to the subcylinder 62 is an exhaust fluid from the main cylinder 11. The energy can be therefore effectively utilized.

Next, the high-pressure fluid from the pump 27 is supplied to one supply/exhaust passage 32 by switching over the changeover valve 29. The other supply/exhaust passage 33 is connected to the tank 28. Hereupon, the high-pressure fluid flows into the insertion hole 14 and the subchamber 20, thereby moving the piston 16 toward the other stroke end. At this time, the high-pressure fluid flows into both the subchambers 56 and 58 of the subcylinder 62. However, a pressure receiving area of the piston 48 on the side of the subchamber 58 is larger than a pressure receiving area of the piston 48 on the side of the subchamber 56. Therefore, the piston 48 is thrust by the high-pressure fluid and thus moves to the stroke end on the rod side. The piston 48 thereby reverts to an initial state. The subcylinder 63 hereafter operates. The operation thereof is, however, substantially the same as the above-mentioned, and the detailed description will be omitted.

Further, the stroke of the main cylinder 11 is adjusted; i.e., the stroke during a movement from, e.g., the head side to the rod side is made shorter by, e.g., 10 mm than the present stroke. In this case, the slider 80 and the microswitch 84 are integrally moved by 10 mm toward one end (left side in FIG. 4) by rotating the screw shaft 86 with the knob 88. With this action, the piston 48 of the subcylinder 62 moves up to a position 10 mm away on this side from the head-side stroke end. Then, the engagement member 60 engages with the microswitch 84, thereby stopping the operation of the main cylinder 11. At this time, as described above, there exists the one-to-one corresponding relationship in terms of position between the piston 16 of the main cylinder 11 and the piston 48 of the subcylinder 62. Therefore, the piston 16 of the main cylinder 11 also stops in the position 10 mm away on this side from the rod-side stroke end. Note that the stroke in the subcylinder 63 is adjusted in the same manner as the above-mentioned. Further, the stroke can be also adjusted by regulating the openings of the flow rate control valves 70, 74 in the above-described case without shifting the positions of the microswitches 84, 85.

Incidentally, in the embodiment discussed above, the position of the piston 16 of the main cylinder 11 is detected with the aid of the subcylinders 62, 63; and the stroke of the main cylinder is adjusted. According to the present invention, a different operation from the main cylinder may be performed with the aid of the subcylinder. For example, a fixing pin for fixing clamped dies to each other may be moved. Alternatively, an absolutely different operation, e.g., a feeding operation, may be effected. Further, the microswitches 84, 85 are employed in the embodiment discussed above. According to the present invention, however, a neighboring switch or the like may be used. Furthermore, according to the present invention, any one of the subcylinders 62, 63 may be omitted. The single subcylinder is prepared.

As discussed above, according to the present invention, it is possible to effectively restrain a loss of energy with the simplified structure at the low cost.

Although the illustrative embodiment of the present invention has been described in detail with reference to the accompanying drawings, it is to be understood that the present invention is not limited to that embodiment. Various changes or modifications may be effected by one skilled in the art without departing from the scope or spirit of the invention.

What is claimed is:

1. A cylinder apparatus comprising:

a main cylinder incorporating a cylinder chamber partitioned into two subchambers by a piston;

a pair of supply/exhaust passages, connected to said two subchambers of said main cylinder, for supplying and exhausting a fluid to and from said two subchambers;

a cut-off member, provided on said piston of said main cylinder, for cutting off a communication between said one subchamber from which the fluid is pushed and said one supply/exhaust passage on a low pressure side when said piston moves toward one stroke end and reaches the vicinity of said one stroke end;

a subcylinder incorporating a cylinder chamber partitioned into two subchambers by a piston;

a connection passage for always connecting any one of said subchambers of said subcylinder to said one subchamber of said main cylinder and causing a movement of said piston of said subcylinder by leading the fluid of said one subchamber of said main cylinder having an increased pressure due to a cut-off by said cut-off member into said subchamber of said subcylinder;

an escape passage for connecting the middle of said connection passage to said one supply/exhaust passage on the low pressure side and escaping the fluid of said connection passage to said one supply/exhaust passage on the low pressure side; and a flow rate control valve, provided in the middle of said escape passage, for controlling a flow rate of the fluid to be escaped.

2. The cylinder apparatus according to claim 1, further comprising: another cut-off member, provided on said piston of said main cylinder, for cutting off a communication between said other subchamber from which the fluid is pushed and said other supply/exhaust passage on the low pressure side when said piston moves toward the other stroke end and reaches the vicinity of said other stroke end; another subcylinder incorporating a cylinder chamber partitioned into two subchambers by a piston; a connection passage for always connecting any one of said subchambers of said another subcylinder to said other subchambers of said main cylinder and causing a movement of said piston of said subcylinder by leading the fluid of said other subchamber of said main cylinder having an increased pressure due to a cut-off by said another cut-off member into said subchamber of said another subcylinder; another escape passage for connecting the middle of said another connection passage to said other supply/exhaust passage on the low pressure side and escaping the fluid of said another connection passage to said other supply/exhaust passage on the low pressure side; and another flow rate control valve, provided in the middle of said another escape passage, for controlling a flow rate of the fluid to be escaped.

3. The cylinder apparatus according to claim 1 or 2, wherein said connection passage is constructed of a long pipe, and said main cylinder and said subcylinder are disposed far away from each other.

4. The cylinder apparatus according to claim 1 or 2, wherein said cut-off member is a buffer insertion member provided on a rod member of said piston, and the communication between said subchamber of said main cylinder and said low-pressure-side supply/exhaust passage is cut off when said insertion member is inserted into an insertion hole formed in a cylinder case of said main cylinder.

5. The cylinder apparatus according to claim 1 or 2, wherein a switch is provided in the vicinity of said subcylinder, an engagement member capable of engaging with said switch is provided on said rod member of said piston of said subcylinder, and said switch is disconnected by said engagement member.

6. The cylinder apparatus according to claim 1 or 2, wherein said piston of said subcylinder is made to reach the stroke end when said piston of main cylinder reaches the stroke end by controlling the flow rate of the fluid passing through said flow rate control valve.

* * * * *